US011823828B2

(12) United States Patent
Chung et al.

(10) Patent No.: US 11,823,828 B2
(45) Date of Patent: Nov. 21, 2023

(54) INDUCTIVE DEVICE AND METHOD OF MANUFACTURING THE SAME

(71) Applicant: CHILISIN ELECTRONICS CORP., Hsinchu County (TW)

(72) Inventors: Jui-Min Chung, Taoyuan (TW); Chia-Chen Chen, Taoyuan (TW); Hung-Pin Lin, Taoyuan (TW)

(73) Assignee: CHILISIN ELECTRONICS CORP., Hsinchu County (TW)

( * ) Notice: Subject to any disclaimer, the term of this patent is extended or adjusted under 35 U.S.C. 154(b) by 0 days.

(21) Appl. No.: 17/540,240

(22) Filed: Dec. 2, 2021

(65) Prior Publication Data

US 2023/0061677 A1 Mar. 2, 2023

(30) Foreign Application Priority Data

Aug. 26, 2021 (TW) ..... 110131567

(51) Int. Cl.

| | |
|---|---|
| ***H01F 27/28*** | (2006.01) |
| ***H01F 27/02*** | (2006.01) |
| ***H01F 27/24*** | (2006.01) |
| ***H01F 41/06*** | (2016.01) |

(52) U.S. Cl.

CPC ..... *H01F 27/28* (2013.01); *H01F 27/02* (2013.01); *H01F 27/24* (2013.01); *H01F 41/06* (2013.01)

(58) Field of Classification Search

CPC ..... H01F 27/28; H01F 27/02; H01F 27/24; H01F 41/06; H01F 27/292; H01F 27/29

See application file for complete search history.

(56) References Cited

U.S. PATENT DOCUMENTS

| | | | | |
|---|---|---|---|---|
| 5,912,609 | A * | 6/1999 | Usui | H01F 17/043 336/83 |
| 6,922,130 | B2 * | 7/2005 | Okamoto | H01F 27/027 336/198 |
| 8,310,332 | B2 | 11/2012 | Yan et al. | |
| 9,620,270 | B2 | 4/2017 | Uemoto et al. | |
| 10,141,104 | B2 * | 11/2018 | Habraken | H01F 38/14 |

(Continued)

FOREIGN PATENT DOCUMENTS

| | | |
|---|---|---|
| CN | 105185507 A | 12/2015 |
| CN | 102105953 B | 5/2017 |

(Continued)

*Primary Examiner* — Mang Tin Bik Lian

(74) *Attorney, Agent, or Firm* — Li & Cai Intellectual Property Office

(57) ABSTRACT

An inductive device and a method of manufacturing the same are provided. The inductive device includes a magnetic base, a coil structure, and a package structure. The magnetic base includes a bottom plate, a core column, and a lateral wall defining a positioning trench. The coil structure includes a coil body, a first extending section, and a second extending section. The coil body disposed in the positioning trench surrounds the core column. The first extending section includes a first bent portion and a first terminal portion connected at a first connecting point. The second extending section includes a second bent portion and a second terminal portion connected at a second connecting point. A shortest distance between a first imaginary connection line defined between the first and second connecting points and a central axis of the core column is less than a minimum outer radius of the coil body.

10 Claims, 15 Drawing Sheets

(56) References Cited

U.S. PATENT DOCUMENTS

| | | | | |
|---|---|---|---|---|
| 10,804,026 | B2 | 10/2020 | Yamashita et al. | |
| 11,069,474 | B2 | 7/2021 | Ooi et al. | |
| 11,361,898 | B2 | 6/2022 | Ogasawara | |
| 11,538,636 | B2 | 12/2022 | Yokota | |
| 2002/0130752 | A1* | 9/2002 | Kuroshima | H01F 27/34 336/200 |
| 2003/0222749 | A1* | 12/2003 | Kung | H01F 17/043 336/192 |
| 2007/0216512 | A1* | 9/2007 | Sano | H01F 17/043 336/212 |
| 2009/0231077 | A1* | 9/2009 | Liao | H01F 17/04 29/606 |
| 2010/0085139 | A1* | 4/2010 | Yan | H01F 41/0246 29/606 |
| 2010/0277267 | A1 | 11/2010 | Bogert et al. | |
| 2010/0308950 | A1* | 12/2010 | Hsieh | H01F 27/022 336/221 |
| 2014/0313003 | A1* | 10/2014 | Liu | H01F 27/292 336/178 |
| 2019/0371512 | A1* | 12/2019 | Dai | H01F 27/24 |
| 2020/0312533 | A1 | 10/2020 | Mori | |
| 2020/0411226 | A1 | 12/2020 | Yamashita et al. | |

FOREIGN PATENT DOCUMENTS

| | | | |
|---|---|---|---|
| CN | 104488042 | B | 1/2018 |
| CN | 112509797 | A | 3/2021 |
| JP | 5933216 | U | 3/1884 |
| JP | 2010267768 | A | 11/2010 |
| JP | 2016225479 | A | 12/2016 |
| JP | 2019197781 | A | 11/2019 |
| JP | 202035966 | A | 3/2020 |
| JP | 202127202 | A | 2/2021 |
| TW | I588849 | B | 6/2017 |
| TW | I724965 | B | 4/2021 |

* cited by examiner

INDUCTIVE DEVICE AND METHOD OF MANUFACTURING THE SAME

CROSS-REFERENCE TO RELATED PATENT APPLICATION

This application claims the benefit of priority to Taiwan Patent Application No. 110131567, filed on Aug. 26, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a passive device and a method of manufacturing the same, and more particularly to an inductive device and a method of manufacturing the same.

BACKGROUND OF THE DISCLOSURE

An inductor is a passive device that has been widely used in a circuit design. Inductors may have different structures depending on different requirements. In one conventional inductor, a coil is wound on a magnetic core. Specifically, the magnetic core includes a bottom base and a core column protruding from the bottom base. When the coil is fabricated and wound on the magnetic core, the core column can serve as a supporting structure so as to form a winding portion of the coil, and non-wound portions, i.e., other portions that are not wound on the core column, are fixed to the bottom base of the magnetic core. However, when the non-wound portions are bent and fixed on the bottom base, the bottom base may be damaged and then have cracks formed therein.

Furthermore, when a molding process is performed to form a magnetic molding structure covering the magnetic core and the coil, the coil is easily deformed or displaced due to being squeezed. The cracks formed in the bottom base, and the deformation or the displacement of the coil, would cause the inductor to exhibit a poor electrical performance, thereby reducing a reliability of the inductor. As such, how the structure and the manufacturing method of the inductor can be modified to maintain the reliability of the inductor at a required level and to improve the electrical properties of the inductor, is still one of the issues to be solved in the related art.

SUMMARY OF THE DISCLOSURE

In response to the above-referenced technical inadequacies, the present disclosure provides an inductive device and a method of manufacturing the same so as to improve electrical properties and a reliability of the inductor device.

In one aspect, the present disclosure provides an inductive device including a magnetic base, a coil structure, and a package structure. The magnetic base includes a bottom plate, a lateral wall, and a core column. The lateral wall and the core column both protrude from a surface of the bottom plate, and the bottom plate, the lateral wall and the core column jointly define a positioning trench. The coil structure includes a coil body, a first extending section, and a second extending section. The coil body is disposed in the positioning trench and surrounds the core column. The first extending section includes a first bent portion and a first terminal portion connected thereto. The first bent portion is bent from the coil body in a direction away from the bottom plate and has a first connecting point, and the first terminal portion extends from the first connecting point to a position above the lateral wall. The second extending section includes a second bent portion and a second terminal portion connected thereto. The second bent portion is bent from the coil body in a direction away from the bottom plate and has a second connecting point, and the second terminal portion extends from the second connecting point to a position above the lateral wall. The package structure covers the magnetic base and the coil structure. A first conductive part of the first terminal portion and a second conductive part of the second terminal portion are both exposed outside of the package structure. A first imaginary connection line is defined between the first connecting point and the second connecting point, and a shortest distance between the first imaginary connection line and a central axis of the core column is less than a minimum outer radius of the coil body.

In another aspect, the present disclosure provides a method of manufacturing an inductive device. A magnetic base including a core column and defining a positioning trench that surrounds the core column is provided. A coil structure including a coil body, a first extending section, and a second extending section is formed, in which the coil body has a through hole. The first extending section includes a first bent portion and a first terminal portion connected thereto, and the second extending section includes a second bent portion and a second terminal portion connected thereto. The first bent portion and the second bent portion are both bent from the coil body toward a same side of the coil body, and respectively have a first connecting point and a second connecting point. A first imaginary connection line is defined between the first and second connecting points. A shortest distance between the first imaginary connection line and a central axis of the through hole is less than a minimum outer radius of the coil body. The first terminal portion and the second terminal portion respectively extend from the first connecting point and the second connecting point and protrude from a side surface of the coil body. The coil structure is arranged in the positioning trench by sleeving the coil body around the core column. A package structure is formed to cover the magnetic base and the coil structure. A first conductive part of the first terminal portion and a second conductive part of the second terminal portion are exposed outside of the package structure.

Therefore, in the inductive device and the method of manufacturing the same provided by the present disclosure, by virtue of "the magnetic base including a core column, and defining a positioning trench therein that surrounds the core column," "the coil structure being arranged in the positioning trench and including a coil body, a first extending section including a first bent portion and a first terminal portion connected thereto, and a second extending section including a second bent portion and a second terminal portion connected thereto," "the first and second bent portions being bent from the coil body toward the same direction, and respectively having a first connecting point and a second connecting point, in which a first imaginary connection line is defined between the first and second connecting points, and a shortest distance between the first imaginary connection line and a central axis of the core column is less than a minimum outer radius of the coil body" and "the first and second terminal portions respectively extending from the first and second connecting points and protruding from a side surface of the coil body," the reliability of the inductive device can be maintained at a required level, and the inductive device can exhibit a better electrical performance.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
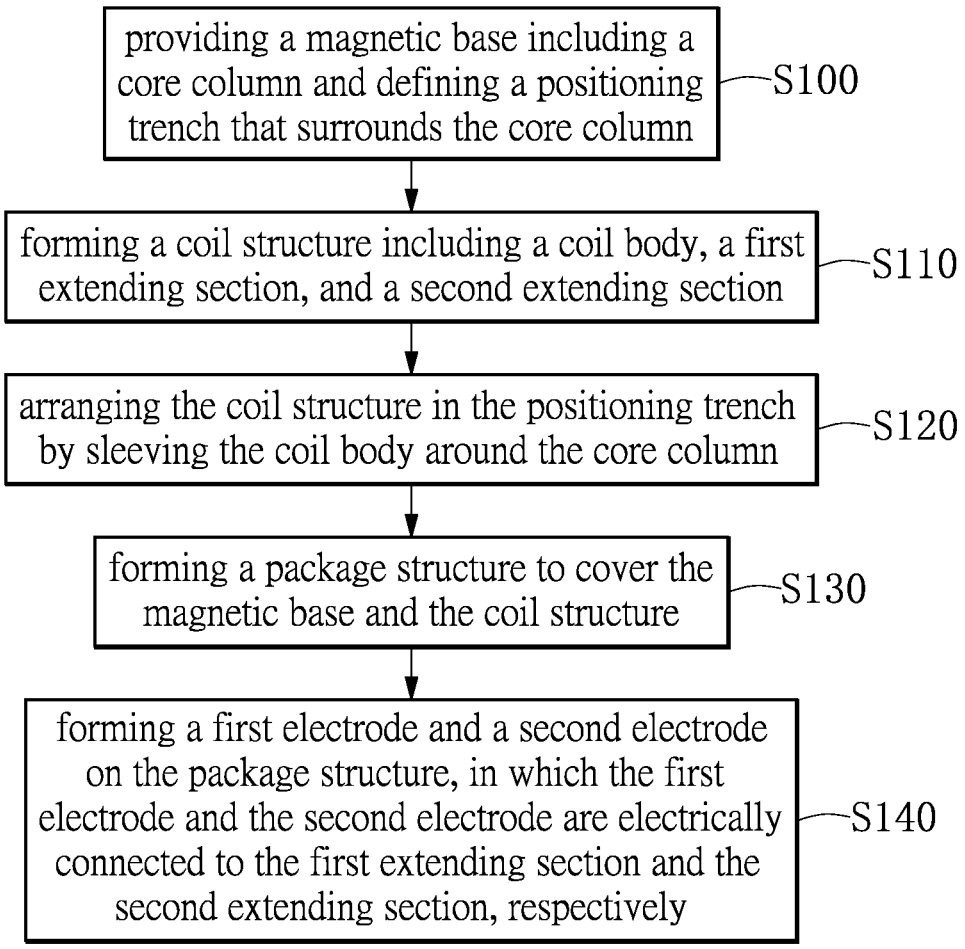
FIG. 1 is a flowchart of a method of manufacturing an inductive device according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Reference is made to FIG. 1, which is a flowchart of a method of manufacturing an inductive device according to an embodiment of the present disclosure. In step S100, a magnetic base magnetic including a core column and defining a positioning trench that surrounds the core column is provided. In step S110, a coil structure including a coil body, a first extending section, and a second extending section is formed. In step S120, the coil structure is arranged in the positioning trench by sleeving the coil body around the core column. In step S130, a package structure is formed to cover the magnetic base and the coil structure. In step S140, a first electrode and a second electrode are formed on the package structure and electrically connected to the first extending section and the second extending section, respectively. The details of an inductive device in each step will be further described in the following descriptions.

Figure 2:
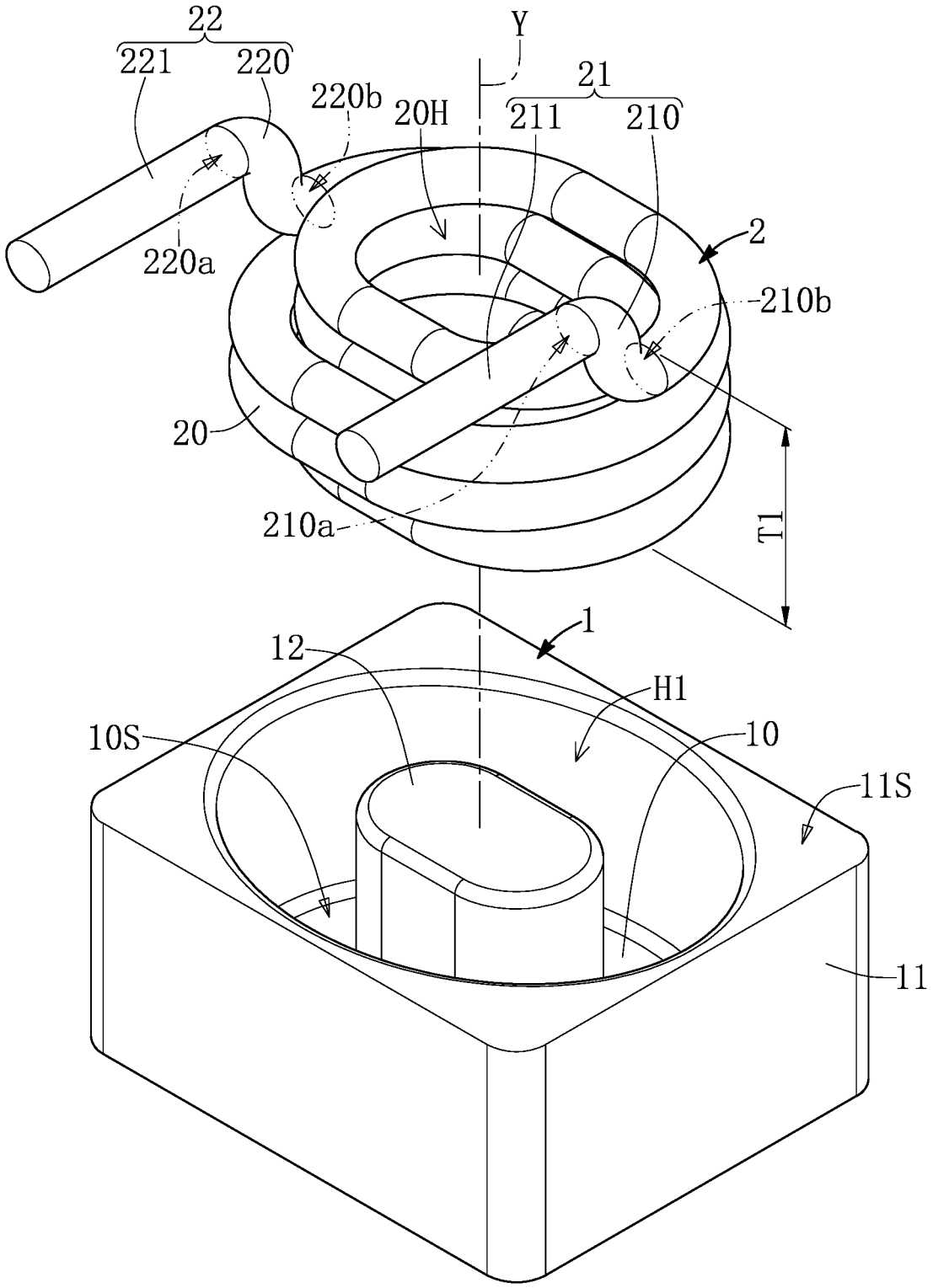
FIG. 2 is a schematic exploded view of a coil structure and a magnetic base according to the embodiment of the present disclosure.

Reference is made to FIG. 2, which is a schematic exploded view of a coil structure and a magnetic base according to the embodiment of the present disclosure. The magnetic baes 1 defines the positioning trench H1 therein. Specifically, the magnetic base 1 includes a bottom plate 10, a lateral wall 11, and a core column 12 that jointly define the positioning trench H1. The lateral wall 11 and the core column 12 both protrude from a surface 10S of the bottom plate 10. Moreover, the lateral wall 11 is arranged to surround the coil column 12 so as to define the positioning trench 11 in a closed loop shape. For example, from a top view, the positioning trench H1 can be in an annular shape, an elliptical ring shape, a rectangle ring shape, a D shape, or other asymmetrical shapes. Furthermore, in the instant embodiment, the lateral wall 11 is an enclosed wall, and a top surface 11S of the lateral wall 11 is a flat surface, but the present disclosure is not limited thereto.

In one embodiment, the magnetic base 1 is made of magnetic material. The aforementioned magnetic material includes at least one of crystalline magnetic metal powder and amorphous magnetic metal powder. The crystalline magnetic metal powder can be, for example, but not limited to, Fe-Si powder, Fe-Si-Cr powder, Fe-Si-Al powder, Fe-Ni powder, carbonyl iron powder (CIP), iron powder, Fe-Ni-Mo powder, Fe-Co-V powder, or any combination thereof. The amorphous magnetic metal powder can be Fe-based amorphous magnetic metal powder, such as, Fe-Si-B-C, Fe-Si-Cr-B-P-C, or any combination thereof, but the present disclosure is not limited thereto. The magnetic base 1 of the embodiment in the present disclosure is mainly made of the crystalline magnetic metal powder, such as, a material that contains carbonyl iron powder. Furthermore, the magnetic base 1 can be fabricated by any process well-known in this industry, such as a cold-pressing process, a hot-pressing process, a transfer molding process, a compression molding process, and so on.

Reference is made to FIG. 2. The coil structure 2 can be fabricated by winding a conductive wire so as to form a coil body 20, a first extending section 21, and a second extending section 22. For example, the conductive wire can be wound in a flat manner, an inside and outside manner, or an alpha manner to form the coil structure 2. The aforementioned conductive wire can be a flat wire or a round wire, and includes an inner conductive line and an insulation covering layer, but the present disclosure is not limited thereto.

The coil body 20 of the instant embodiment includes a plurality of loops (not designated by any reference numerals), and the loops are arranged to surround the same central axis Y. Accordingly, the coil body 20 has a through hole 20H. It should be noted that in the instant embodiment, before the coil structure 20 is placed into the positioning trench H1, the first extending section 21 and the second extending section 22 are each bent in advance to form a bending angle. To be more specific, as shown in FIG. 1, the first extending section 21 and the second extending section 22 are bent toward the same side (for example, a top side) of the coil body 20 and then extend beyond the topmost one of the loops. Thereafter, the first extending section 21 and the second extending section 22 are bent again, and then extend in two tangent directions, respectively, beyond a side surface of the coil body 20.

In the instant embodiment, after the first extending section 21 and the second extending section 22 are bent upwardly, the first extending section 21 and the second extending section 22 are bent and then extend toward the same side of the coil body 20, but the present disclosure is not limited thereto. In another embodiment, after the first extending section 21 and the second extending section 22 are bent upwardly, the first extending section 21 and the second extending section 22 are bent and then extend in two different directions.

Specifically, the first extending section 21 includes a first bent portion 210 and a first terminal portion 211 connected thereto, and the second extending section 22 includes a second bent portion 220 and a second terminal portion 221 connected thereto. The first bent portion 210 and the second bent portion 220 extend upwardly and protrude from the topmost one of the loops of the coil body 20.

In the instant embodiment, the first bent portion 210 has a first connecting point 210*a* and a first bent starting point 210*b*. The first bent starting point 210*b* refers to an end at which the first bent portion 210 starts to bend upward from one of the loops. The first connecting point 210*a* refers to a joint end at which the first bent portion 210 is connected to the first terminal portion 211. Similarly, the second bent portion 220 of the second extending section 22 has a second connecting point 220*a* and a second bent starting point 220*b*. The second bent starting point 220*b* refers to an end at which the second bent portion 220 starts to bend upward from one of the loops, and the second connecting point 220*a* refers to a joint end at which the second bent portion 220 is connected to the second terminal portion 221.

The first terminal portion 211 extends from the first connecting point 210*a* along a tangent direction of the topmost one of the loops of the coil body 20 and protrudes from the side surface of the coil body 20. Similarly, the second bent portion 220 of the second extending section 22 has the second connecting point 220*a* and a second bent starting point 220*b*. The second terminal portion 221 extends from the second connecting point 220*a* along another tangent direction of the topmost one of the loops of the coil body 20 and protrudes from the side surface of the coil body 20. An extending direction of the first terminal portion 211 needs not to be parallel to an extending direction of the second terminal portion 221.

It should be noted that in the instant embodiment, a first imaginary connection line A defined between the first and second connecting points 210*a*, 220*a* passes across the through hole 20H of the coil body 20. In one embodiment, from a top view, the first imaginary connection line A defined between the first and second connecting points 210*a*, 220*a* passes across a region between the central axis Y and an outer edge of the core body 20. Furthermore, a second imaginary connection line B defined between the first and second bent starting points 210*b*, 220*b* is contained in a longitudinal reference plane that passes through the through hole 20H of the coil body 20. As such, the first terminal portion 211 and the second terminal portion 221 can each have a longer extension length.

Figure 3:
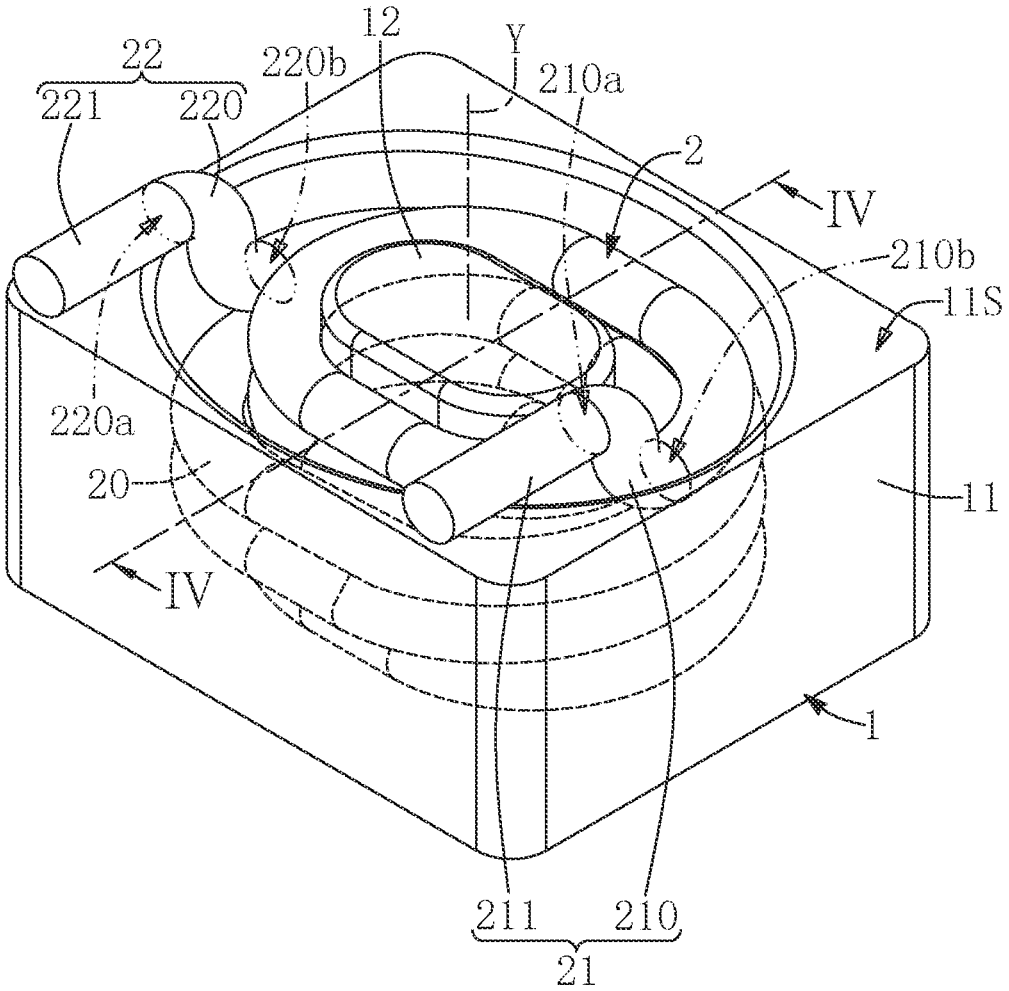
FIG. 3 is a schematic perspective view of the coil structure disposed in the magnetic base according to the present disclosure.

Reference is made to FIG. 3 to FIG. 5A. FIG. 3 is a schematic perspective view of the coil structure disposed in the magnetic base according to the present disclosure, and FIG. 4 and FIG. 5A respectively show a cross-sectional view and a schematic top view of the coil structure disposed in the magnetic base according to the instant embodiment of the present disclosure.

Figure 4:
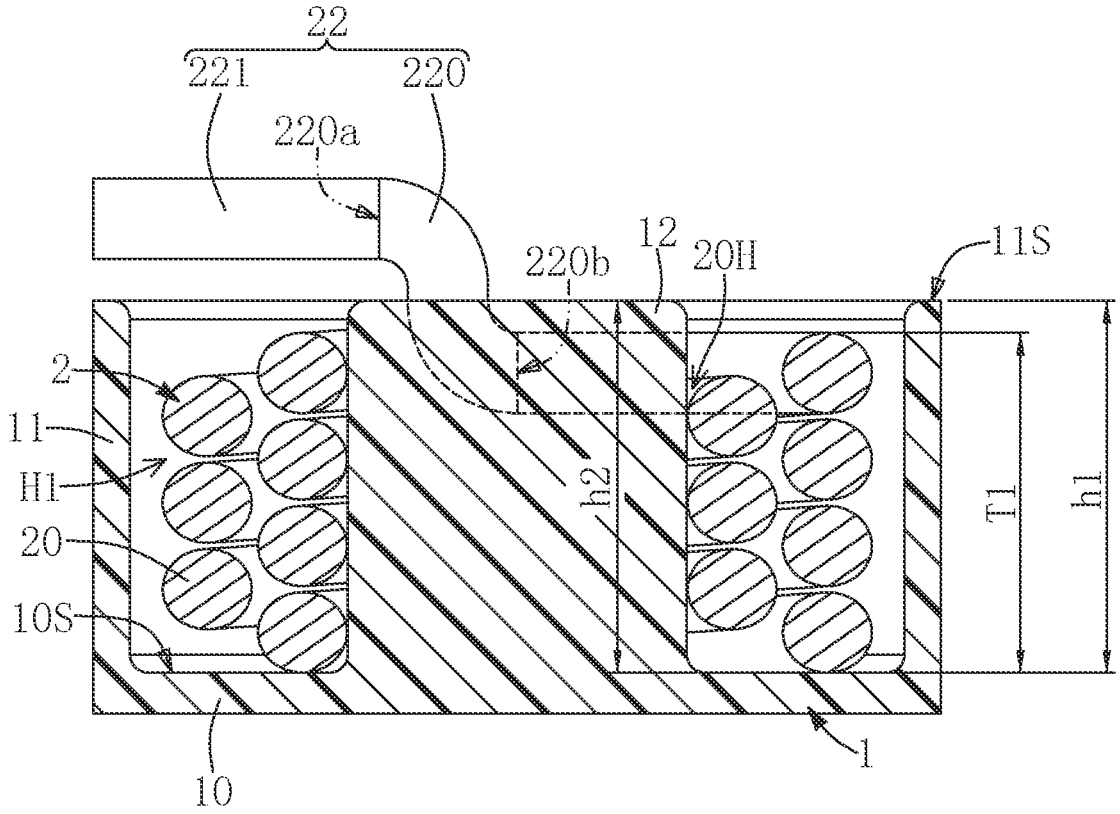
FIG. 4 is a cross-sectional view taken along line IV-IV of FIG. 3.

As shown in FIG. 3 and FIG. 4, the coil structure 2 is sleeved around the core column 12 and arranged in the positioning trench H1 of the magnetic base 1. To be more specific, the coil body 20 is arranged in the positioning trench H1 with the through hole 20H of the coil body 20 being in alignment with the core column 12. It should be noted that the coil structure 2 can be held by the lateral wall 11 and the core column 12 of the magnetic base 1 to be located at a central position, and the lateral wall 11 and the core column 12 can prevent the coil structure 2 from being displaced or deformed due to an external pressure during the following process, which negatively impacts on the electrical properties and yield of the inductive device.

Furthermore, it is not necessary for a height h2 of the core column 12 relative to the bottom plate 10 to be equal to a height h1 of the lateral wall 11 relative to the bottom plate 10. In one preferred embodiment, the height h2 of the core column 12 relative to the bottom plate 10 is equal to or less than the height h1 of the lateral wall 11 relative to the bottom plate 10. Furthermore, the height h2 of the core column 12 is equal to or greater than one half a height T1 of the coil body 20. In the present disclosure, the height T1 of the coil body 20 refers to a vertical distance between a top end and a bottom end of the coil body 20. That is to say, a height position of the top end of the coil body is lower than a top surface of the core column 12, but the present disclosure is not limited thereto.

The preformed magnetic base 1 has a higher density than that of a magnetic body fabricated by molding magnetic powder. Therefore, as the height h2 of the core column 12 relative to the bottom plate 10 is more approximate to the height T1 of the coil body 20, the magnetic material filled in the through hole 20H of the coil body 20 has a higher density, such that the inductive device can have a higher inductance value.

Moreover, the height hl of the lateral wall 11 relative to the bottom plate 10 is greater than or equal to one-third of the height T1 of the coil body 20. In one embodiment, the height hl of the lateral wall 11 relative to the bottom plate 10 is greater than the height T1 of the coil body 20. That is to say, a top end of the coil body 20 is located at a height position lower than a height position of the top surface 11S of the lateral wall 11.

However, as shown in FIG. 3 and FIG. 4, after the coil structure 2 is arranged in the positioning trench H1, the first terminal portion 211 of the first extending section 21 and the second terminal portion 221 both extend above the lateral wall 11. As shown in FIG. 4, in the instant embodiment, the first and second terminal portions 211, 221 are disposed above the lateral wall 11, and spaced apart from the top surface 11S by a distance, but the present disclosure is not limited thereto. In another embodiment, the first and second terminal portions 211, 221 can be arranged to abut the top surface 11S of the lateral wall 11. Furthermore, a height position of each of the first and second connecting points 210*a*, 220*a* is higher than the top surface 11S of the lateral wall 11 of the magnetic base 1.

It should be noted that in the instant embodiment, the top surface 11S of the lateral wall 11 is a flat surface. However, in another embodiment, the top surface 11S of the lateral wall 11 can have two recesses formed thereon that respectively correspond in position to the first and second terminal portions 211, 221. After the coil structure 2 is arranged in the positioning trench H1, the first and second terminal portions 211, 221 can be received in the two recesses, respectively.

As shown in FIG. 4, in the instant embodiment, a width of the positioning trench H1 is maintained at a constant value from an open end to a bottom end thereof, but the present disclosure is not limited thereto. In another embodiment, the width of the positioning trench H1 can be decreased along a direction from the open end to the bottom end, such that a cross-sectional view of the positioning trench H1 is substantially in a trapezoid shape. Furthermore, an inner surface of the lateral wall 11 and a portion of the core column that are near the bottom plate 10 each have a chamfer or a fillet.

Figure 5A:
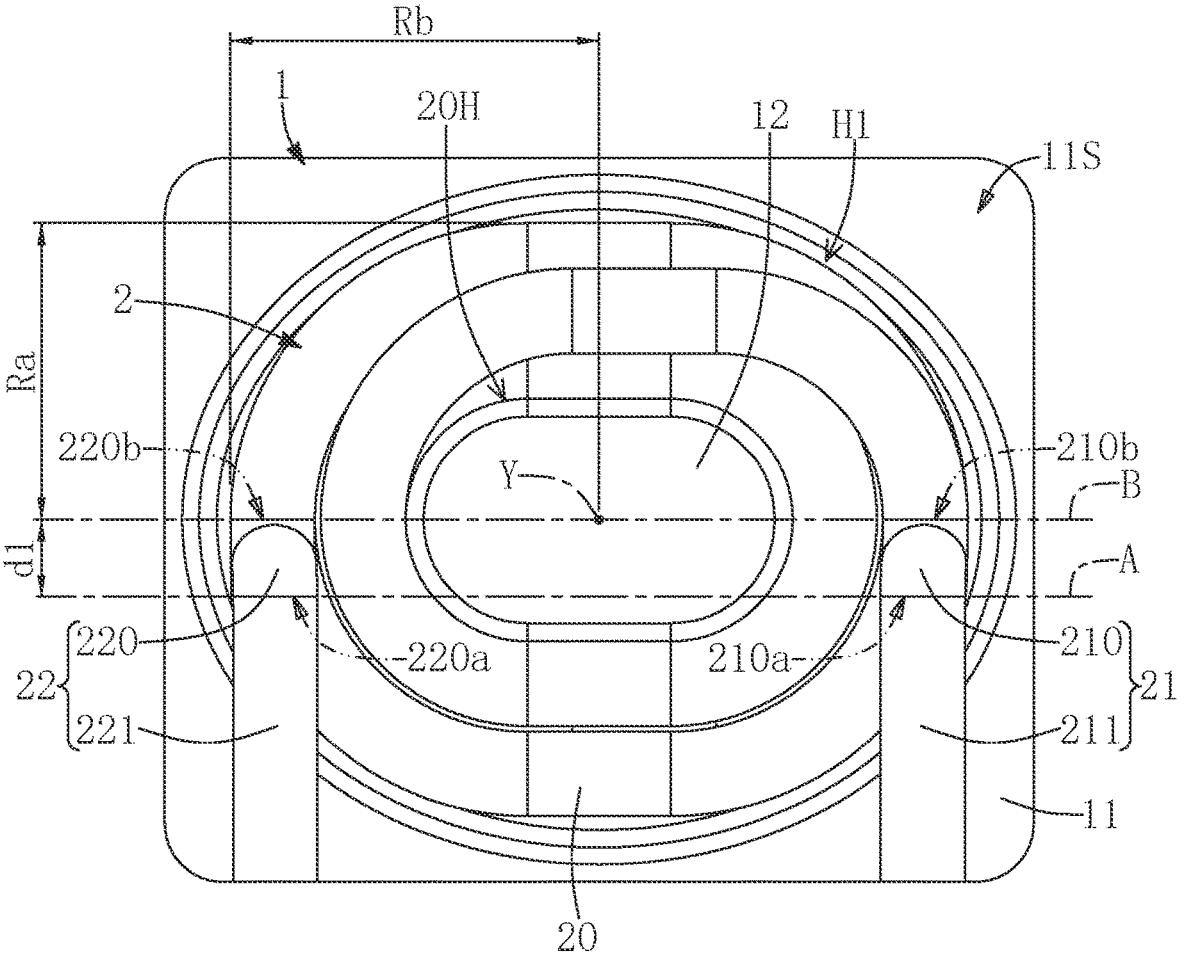
FIG. 5A is a schematic top view of the coil structure disposed in the magnetic base according to the first embodiment of the present disclosure.

Reference is made to FIG. 3 and FIG. 5A. It should be noted that from a top view, it is not necessary for the coil body 20 of the instant embodiment to be in a circle shape. Accordingly, the coil body 20 may have a minimum outer radius Ra and a maximum outer radius Rb. After the coil structure 2 is arranged in the positioning trench H1, from the top view, the first imaginary connection line A defined between the first connecting point 210*a* and the second connecting point 220*a* passes across the coil body 20. To be more specific, the first connecting point 210*a* and the second connecting point 220*a* jointly define the first imaginary connection line A therebetween, a shortest distance d1 between the first imaginary connection line A and the central axis Y of the core column 12 (or the coil body 20) is less than the minimum outer radius Ra of the coil body 20. In one embodiment, the shortest distance d1 between the first imaginary connection line A and the central axis Y of the core column 12 (or the coil body 20) is less than two-thirds of the maximum outer radius Rb of the coil body 20. As such, a contact area between each one of the first and second terminal portions 211, 221 and an external electrode can be increased.

In the instant embodiment, the first imaginary connection line A defined between the first connecting point 210*a* and the second connecting point 22*a* passes through the core column 12 (or the through hole 20H). Furthermore, as shown in FIG. 5A, the second imaginary connection line B defined between the first and second bent starting points 210*b*, 220*b* is contained in a longitudinal reference plane that contains the central axis Y of the core column 12, but the present disclosure is not limited thereto.

Figure 5B:
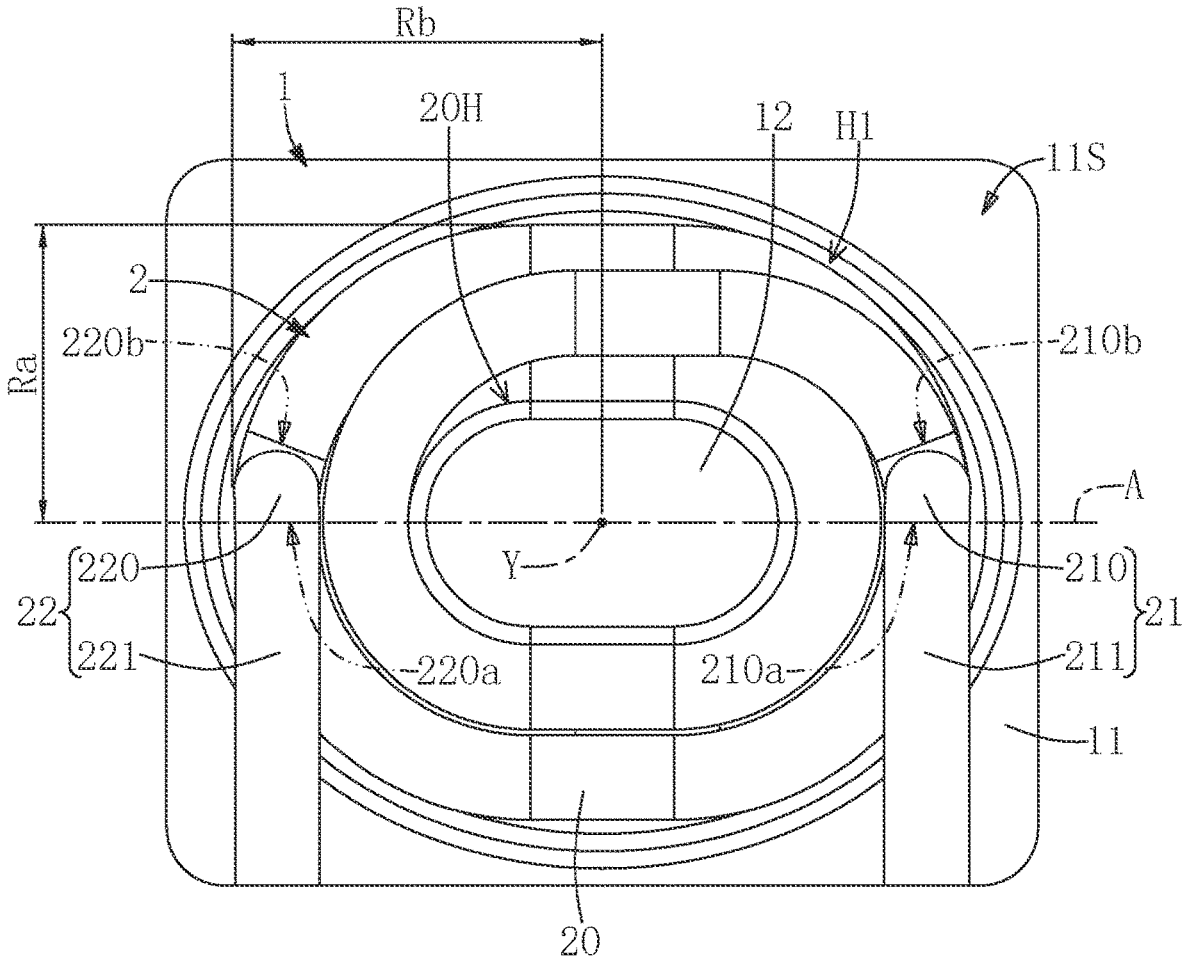
FIGS. 5B-5E are different schematic top views of the coil structure disposed in the magnetic base respectively according to different embodiments of the present disclosure.
Figure 5C:
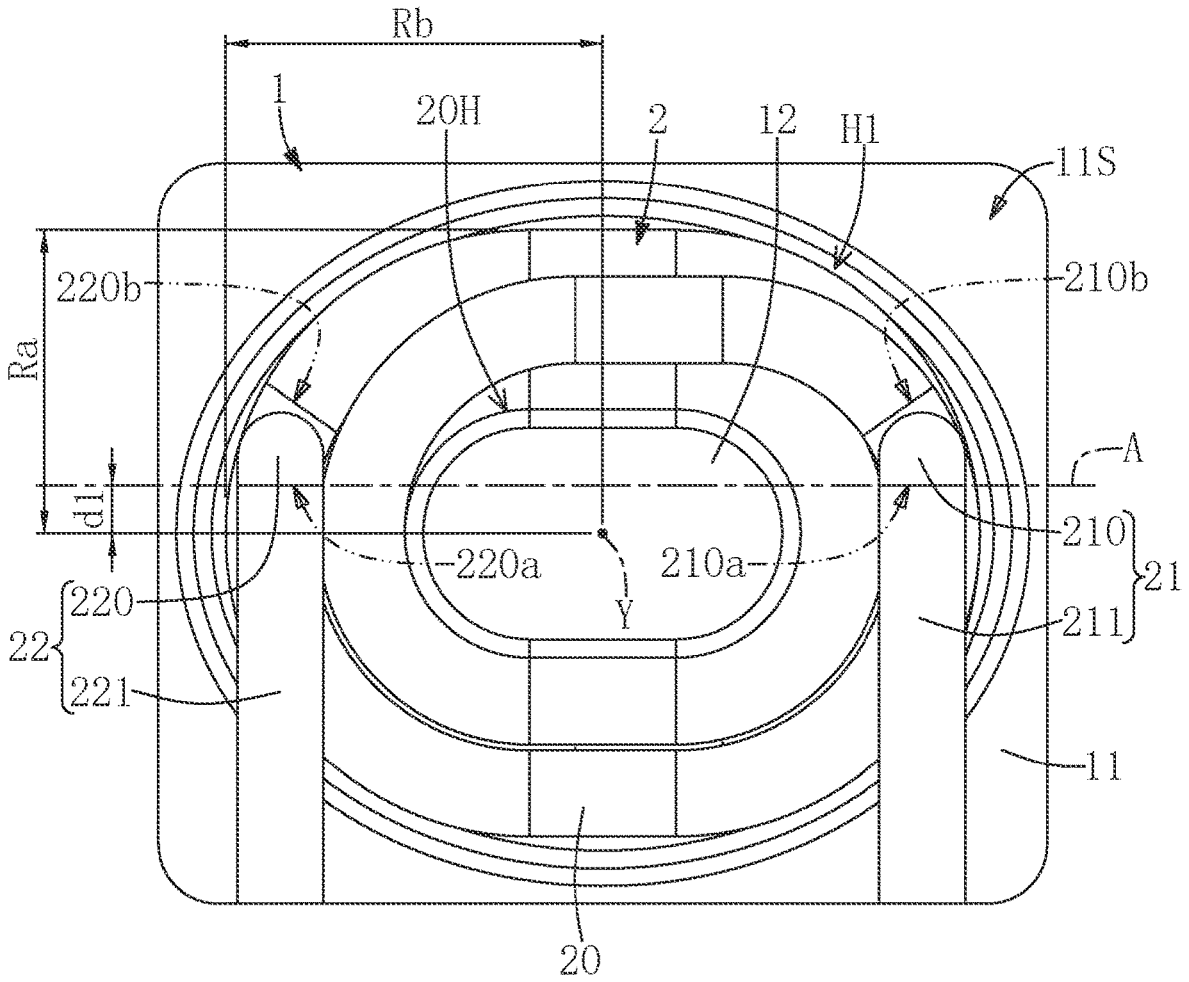
Figure 5D:
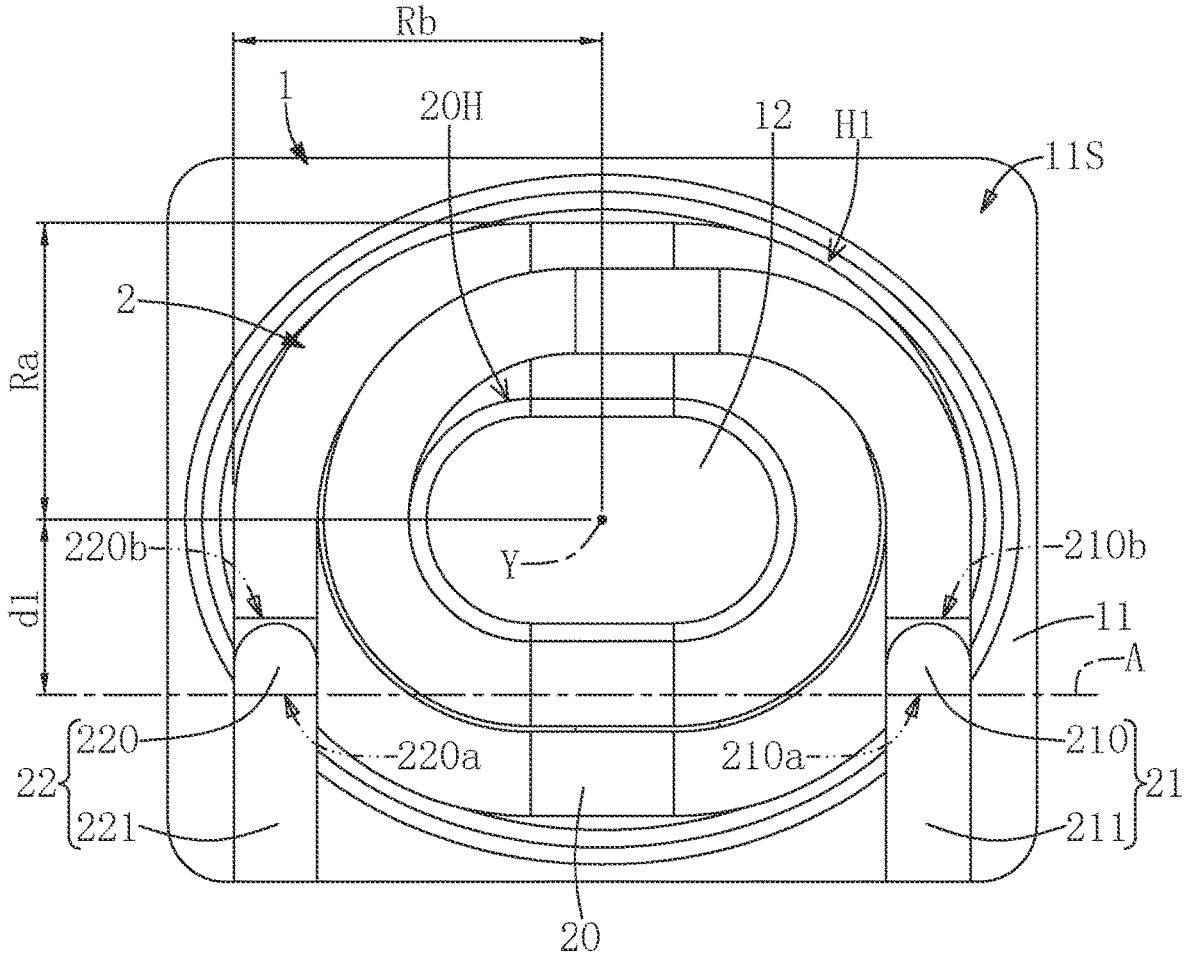

Reference is made to FIG. 5B to FIG. 5E, which respectively show different schematic top views of the coil structure disposed in the magnetic base respectively according to different embodiments of the present disclosure. As shown in FIG. 5B, the first imaginary connection line A defined between the first connecting point 210*a* and the second connecting point 220*a* can pass through the central axis Y of the core column 12 (or the through hole 20H). However, in the embodiment show in FIG. 5D, the first imaginary connection line A defined between the first connecting point 210*a* and the second connecting point 220*a* may not pass through a region above the core column 12 (or the through hole 20H), but the shortest distance dl between the first imaginary connection line A and the central axis Y is still less than the minimum outer radius Ra of the coil body 20.

Figure 5E:
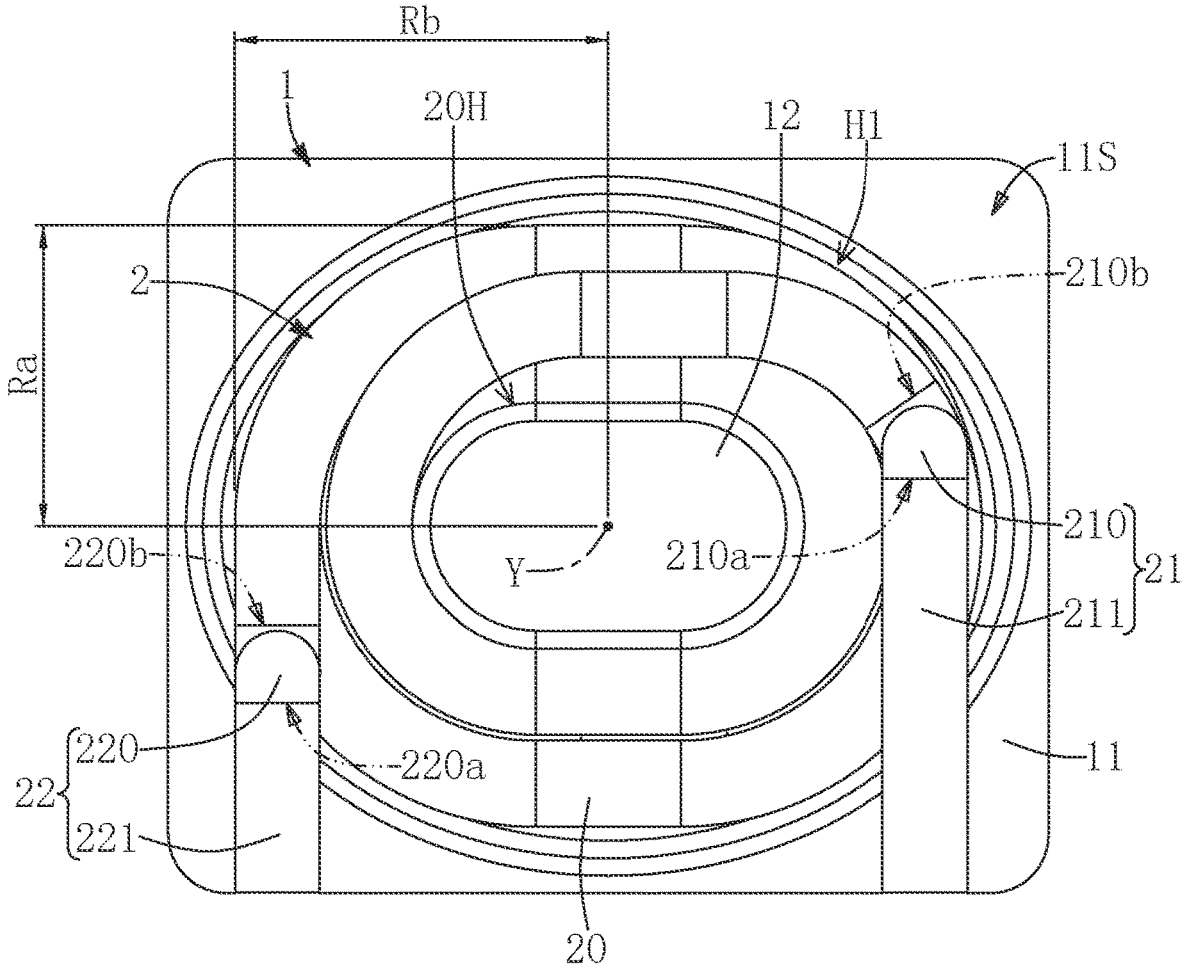

In each of the embodiments respectively shown in FIG. 5A to FIG. 5D, the first imaginary connection line A defined between the first connecting point 210*a* and the second connecting point 220*a* is parallel to the maximum outer radius Rb of the coil body 20. In another embodiment, as shown in FIG. 5E, it is not necessary for the first connecting point 210*a* and the second connecting point 220*a* to be located at the same horizontal reference line. Accordingly, in the embodiment shown in FIG. 5E, the first terminal portion 211 and the second terminal portion 221 can respectively have different lengths.

Figure 6:
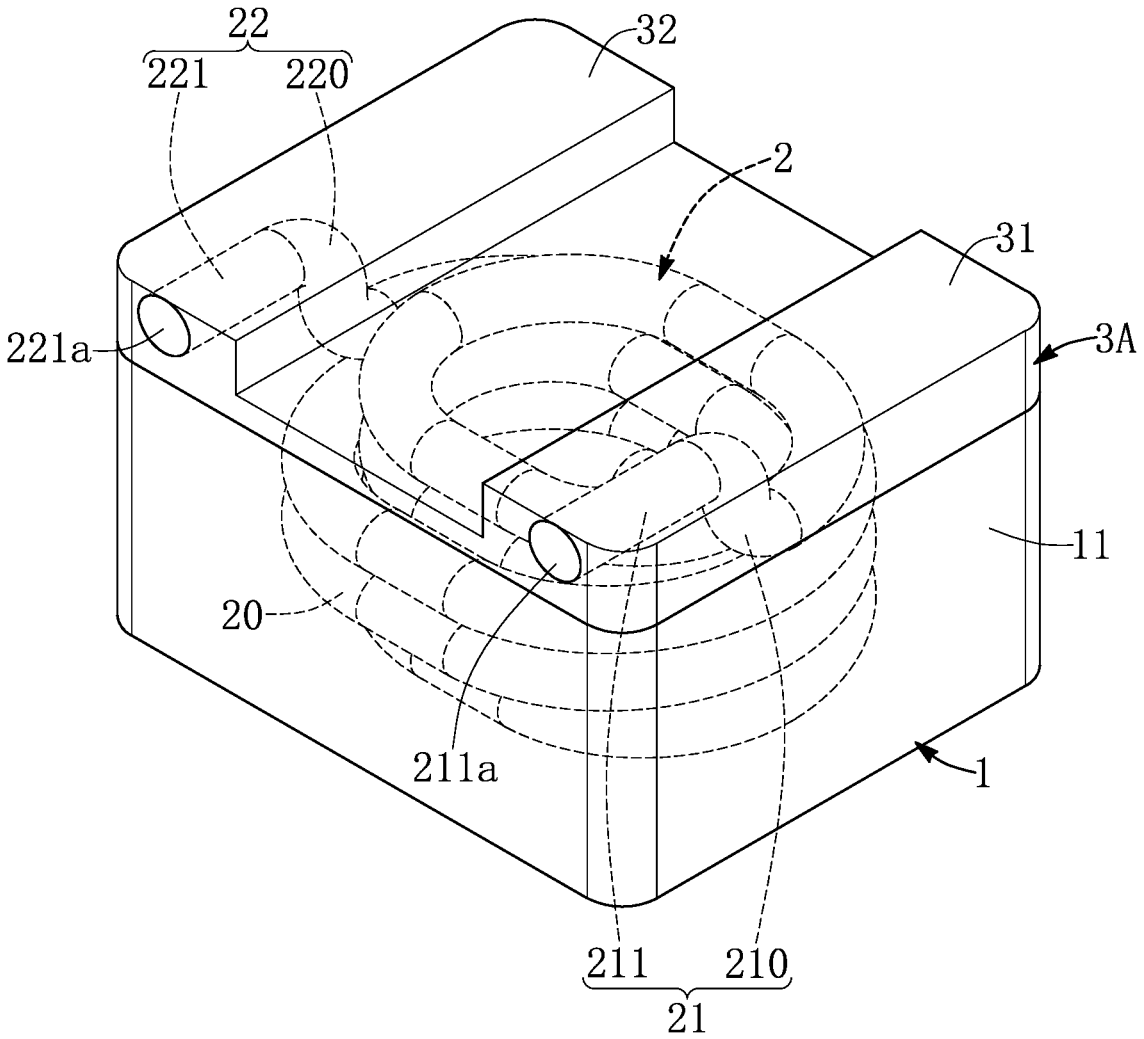
FIGS. 6-8 respectively show steps of forming a package structure according to the embodiment of the present disclosure.
Figure 7:
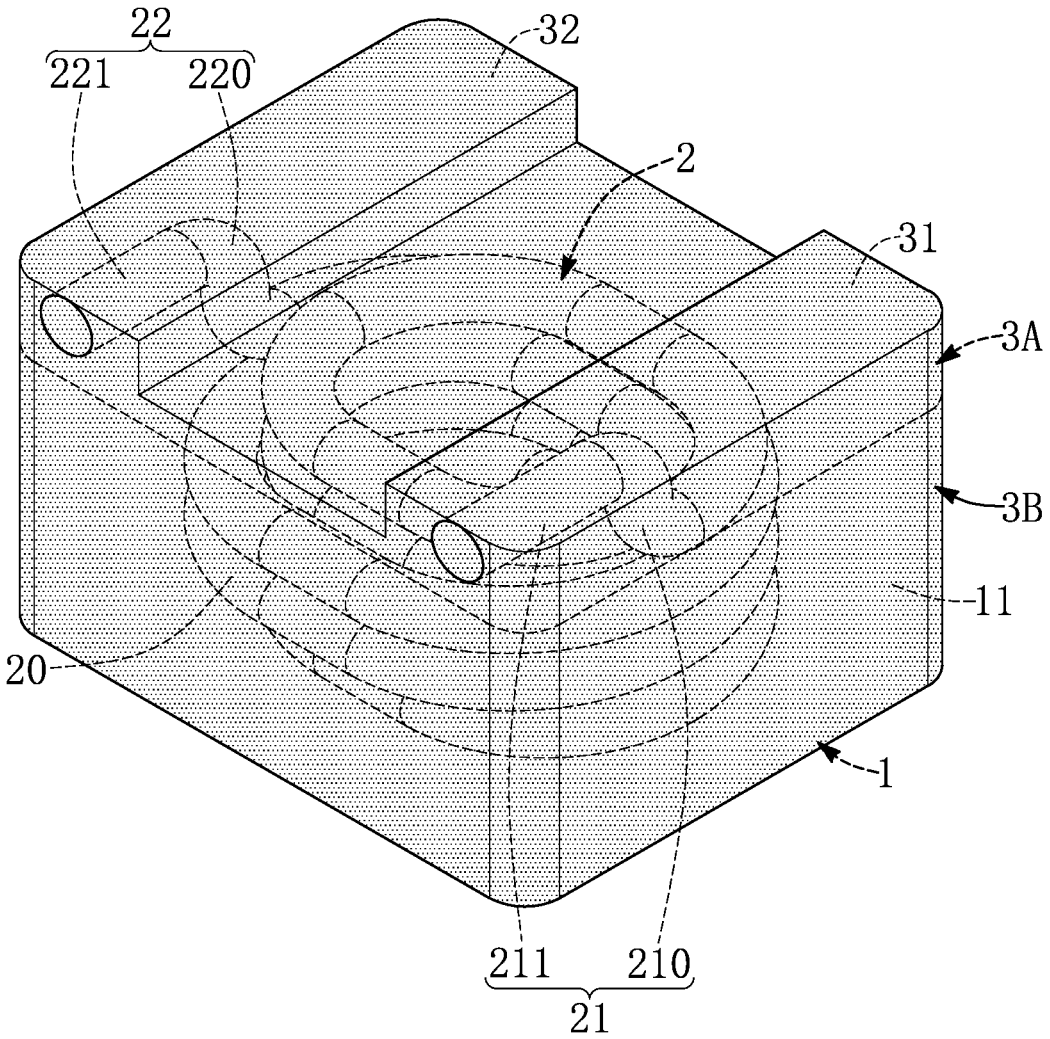
Figure 8:
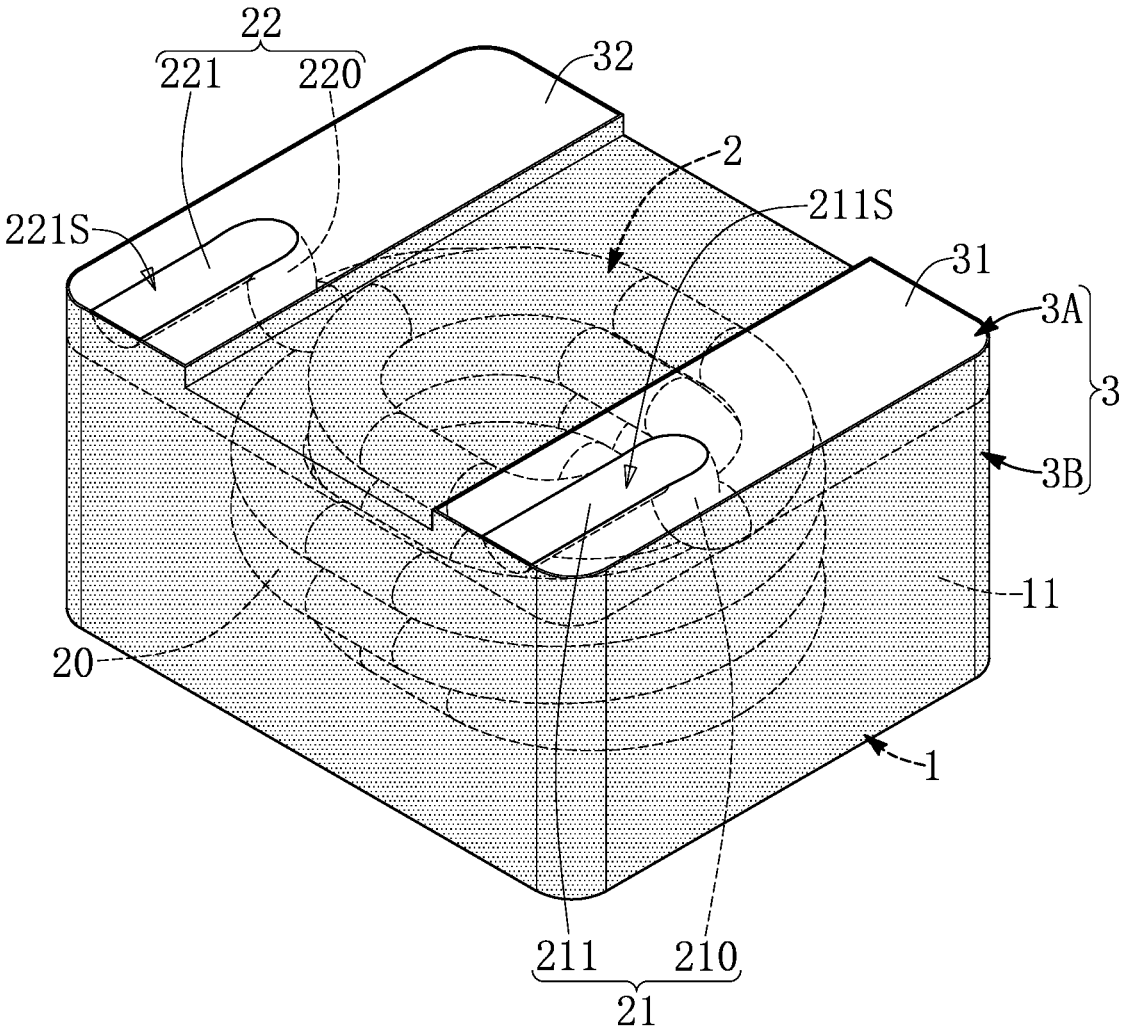

Subsequently, the package structure covering the magnetic base 1 and the coil structure 2 is formed. Reference is made to FIG. 6 to FIG. 8, which respectively show steps of forming the package structure according to the embodiment of the present disclosure. As shown in FIG. 6, a magnetic package body 3A that covers the coil structure 2 and the magnetic base 1 can be formed by a cold-pressing process, a hot-pressing process, a transfer molding process, a compression molding process, and so on. Furthermore, the formation of the magnetic package body 3A can be divided into different stages, in which different magnetic materials may be used or different forming processes may be performed.

In one embodiment, the magnetic package body 3A is formed by a molding process. Specifically, the magnetic base 1 and the coil structure 2 are jointly placed into a cavity of a mold. The cavity is filled with a powder for forming the magnetic package body 3A. The aforementioned powder can include only magnetic powder, or both magnetic powder and non-magnetic powder.

The magnetic powder can include crystalline magnetic metal powder, amorphous magnetic metal powder, or the combination thereof. The crystalline magnetic metal powder can be, for example, but not limited to, Fe-Si powder, Fe-Si-Cr powder, Fe-Si-Al powder, Fe-Ni powder, carbonyl iron powder (CIP), iron powder, Fe-Ni-Mo powder, Fe-Co-V powder, or any combination thereof. The amorphous magnetic metal powder can be Fe-based amorphous magnetic metal powder, such as, Fe-Si-B-C, Fe-Si-Cr-B-P-C, or any combination thereof, but the present disclosure is not limited to the examples provided herein. A majority of the magnetic package body 3A of the embodiment in the present disclosure can be made of the crystalline magnetic metal powder, such as, a material containing the carbonyl iron powder, but the present disclosure is not limited thereto. Furthermore, it is not necessary for the magnetic package body 3A to be made of the same material as that of the magnetic base 1.

It should be noted that in this step, the aforementioned powder can fill into a remaining space in the positioning trench H1 of the magnetic base 1. A pressure is applied to the powder by a punching machine, so that the powder is squeezed and fills the gaps between the coil structure 2 or the magnetic base 1 and the inner walls of the cavity, thereby forming the magnetic package body 3A. That is to say, a portion of the magnetic package body 3A can fill into the positioning trench H1.

It is worth mentioning that in the instant embodiment, before the coil structure 2 is arranged in the positioning trench H1, parts of the first terminal portion 211 and the second terminal portion 221 protruding out of the lateral wall 11 can be cut off. The package structure 3 is then formed. As shown in FIG. 6, after the coil structure 2 is arranged in the positioning trench H1, the first and second terminal portions 211, 221 do not protrude from the external side surface of the lateral wall 11.

In the method of manufacturing the inductive device, after the magnetic package body 3A is taken out of the mold, a curing heat treatment can be performed on the magnetic package body 3A so as to further increase a mechanical strength of the magnetic package body 3A. In one preferred embodiment, applying a pressure to the magnetic package body 3A and performing the curing heat treatment can be simultaneously performed, which makes the magnetic package body 3A become denser.

It should be noted that when the magnetic package body 3A and the magnetic base 1 are made of the same material, after performing the abovementioned punching step and the heat treatment, the magnetic package body 3A and the magnetic base 1 are combined with each other and integrated into one piece. In another embodiment, the magnetic package body 3A and the magnetic base 1 can be respectively made of different materials. Specifically, the materials of the magnetic package body 3A and the magnetic base 1 can include different kinds of magnetic materials, respectively. For example, the magnetic package body 3A can be made of a material containing the carbonyl iron powder, and the magnetic base 1 can be made of Fe-Si-Cr powder, but the present disclosure is not limited to the examples provided herein.

As shown in FIG. 6, the magnetic package body 3A includes a first protruding portion 31 and a second protruding portion 32. The first protruding portion 31 and the second protruding portion 32 are located at the same side of the magnetic package body 3A, and spaced apart from each other. In the instant embodiment, each of the first and second protruding portions 31, 32 is a strip-shaped protrusion. An extending direction of the first protruding portion 31 and an extending direction of the second protruding portion 32 respectively correspond to the extending direction of the first terminal portion 211 and the extending direction of the second terminal portion 221. To be more specific, the first protruding portion 31 and the first terminal portion 211 extend in substantially the same direction, and the second protruding portion 32 and the second terminal portion 221 extend in substantially the same direction.

Reference is made to FIG. 7. The step of forming the package structure can further include a step of forming an insulating layer 3B covering an outer surface of the magnetic package body 3A and an outer surface of the magnetic base 1. In one embodiment, the insulating layer 3B can be formed by performing an atomized spray coating process, a liquid immersion process, a chemical vapor deposition process.

As shown in FIG. 8, a portion of the insulating layer 3B and a portion of the magnetic package body 3A are removed so as to expose a first conductive part 211S of the first terminal portion 211 and a second conductive part 221S of the second terminal portion 221. To be more specific, the first and second protruding portions 31, 32 and portions of the insulating layer 3B covering thereon can be grinded until the first and second terminal portions 211, 221 embedded in the magnetic package body 3A are exposed.

In the instant embodiment, a part of the first terminal portion 211 and a part 10 of the second terminal portion 221 are also removed during the grinding process, so that the first conductive part 211S of the first terminal portion 211 is exposed on the first protruding portion 31, and the second conductive part 221S of the second terminal portion 221 is exposed on the second protruding portion 32. Since the extending direction of the first protruding portion 31 is substantially the same as that of the first terminal portion 311, and the extending direction of the second protruding portion 32 is substantially the same as that of the second terminal portion 221, after the grinding process, the areas of the first and second conductive parts 211S, 221S that are respectively exposed at the surfaces of the first and second protruding portions 31, 32 can be increased.

It is worth mentioning that in the instant embodiment, a plane defined by the extending directions of the first and second terminal portions 211, 221 is substantially parallel to the top surface 11S of the lateral wall 11. Accordingly, after the grinding process, both the first conductive part 211S exposed at the first protruding portion 31 and the second conductive part 221S exposed at the second protruding portion 32 can each have a larger area.

In one embodiment, the exposed area of the first conductive part 211S is greater than a cross-sectional area 211*a* (shown in FIG. 6) of the first terminal portion 211. Similarly, the exposed area of the second conductive part 221S is greater than a cross-sectional area 221*a* (shown in FIG. 6) of the second terminal portion 221. Specifically, the first conductive part 211S (or the second conductive part 221S) exposed at the first protruding portion 31 (or the second protruding portion 32) has a length in the extending direction of the first protruding portion 31 that is greater than a wire diameter of the first terminal portion 211 (or the second terminal portion 221).

Figure 9:
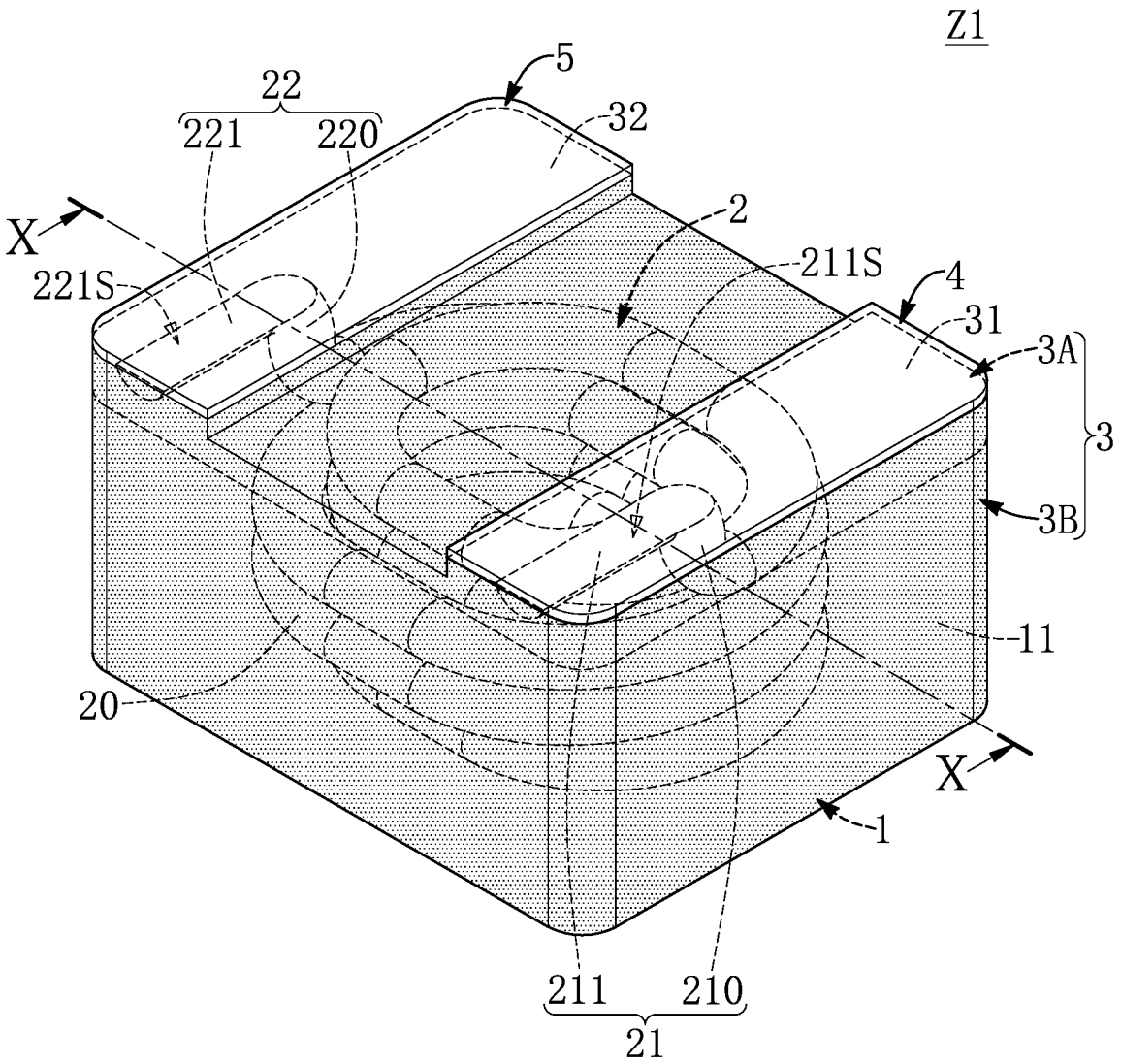
FIG. 9 is a schematic perspective view of an inductive device according to a first embodiment of the present disclosure.
Figure 10:
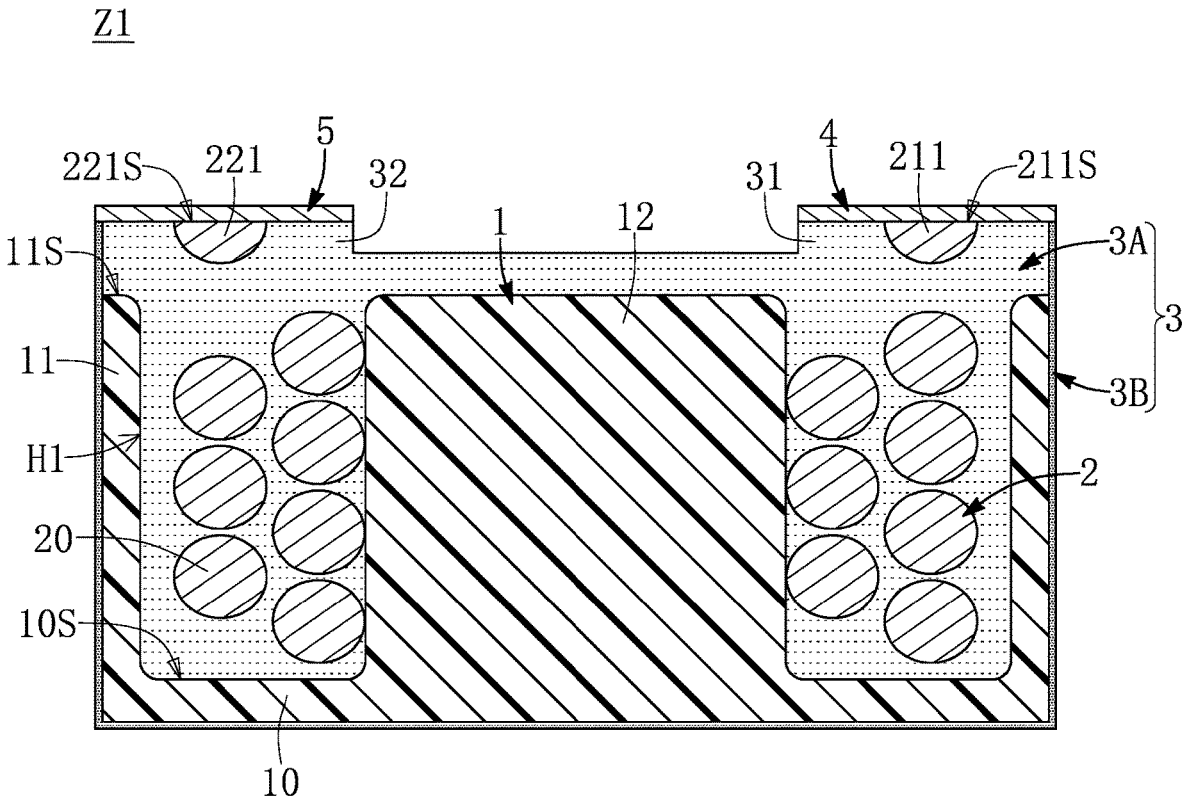
FIG. 10 is a cross-sectional view taken along line X-X of FIGS. 9.

Subsequently, a first electrode 4 and a second electrode 5 are formed on the package structure 3, so as to be electrically connected to the first extending section 21 and the second extending section 22, respectively. Reference is made to FIG. 9 and FIG. 10, in which FIG. 9 is a schematic perspective view of an inductive device according to a first embodiment of the present disclosure, and FIG. 10 is a cross-sectional view taken along line X-X of FIG. 9.

In the inductive device Z1 of the instant embodiment, the first electrode 4 is located at the first protruding portion 31 and in contact with the first conductive part 311S, so as to be electrically connected to the first terminal portion 211. The second electrode 5 is located at the second protruding portion 32 and in contact with the second conductive part 221S, so as to be electrically connected to the second terminal portion 221. As mentioned previously, compared to a conventional inductive structure, in the present disclosure, since the first and second conductive parts 211S, 221S each have a larger exposed area, a contact area between the first electrode 4 and the first conductive part 211S and a contact area between the second electrode 5 and the second conductive part 221S can be increased, thereby increasing a bonding strength between the first electrode 4 and the first conductive part 211S and a bonding strength between the second electrode 5 and the second conductive part 221S. When an external force is applied to the inductive device Z1, the inductive device Z1 can be prevented from being damaged at an interface between the first electrode 4 and the first conductive part 211S or between the second electrode 5 and the second conductive part 221S. Accordingly, a reliability of the inductive device Z1 can be improved.

The first electrode 4 and the second electrode 5 can be formed by an electroplating process, a sputtering process, an evaporation process, etc., and the present disclosure is not limited thereto. In the instant embodiment, the first electrode 4 and the second electrode 5 are located at the same side of the inductive device Z1, and spaced apart from each other. When the inductive device Z1 is mounted on another circuit board, the inductive device Z1 shown in FIG. 9 is flipped over, such that the first and second electrodes 4, 5 face toward the circuit board.

To be more specific, as electronic products are developed toward being lightweight and compact, a density of the components in the electronic product becomes higher, and an interval between any two adjacent ones of the components is reduced. Accordingly, in the inductive device Z1 of the instant embodiment, by arranging the first and second electrodes 4, 5 at the same side, such as, a bottom side, of the inductive device Z1, instead of at two opposite sides, the inductive device Z1 can be prevented from being in contact with adjacent one of the components while the inductive device Z1 is mounted on the circuit board. Furthermore, since magnetic leakage may be generated at the surface of the inductive device Z1, an additional grounded shielding element is usually used to cover the inductive device Z1. By arranging the first electrode 4 and the second electrode 5 at the same side (the bottom side), the first and second electrodes 4, 5 can be prevented from being in contact with the shielding element, and then a short circuit can be prevented from happening.

Figure 11:
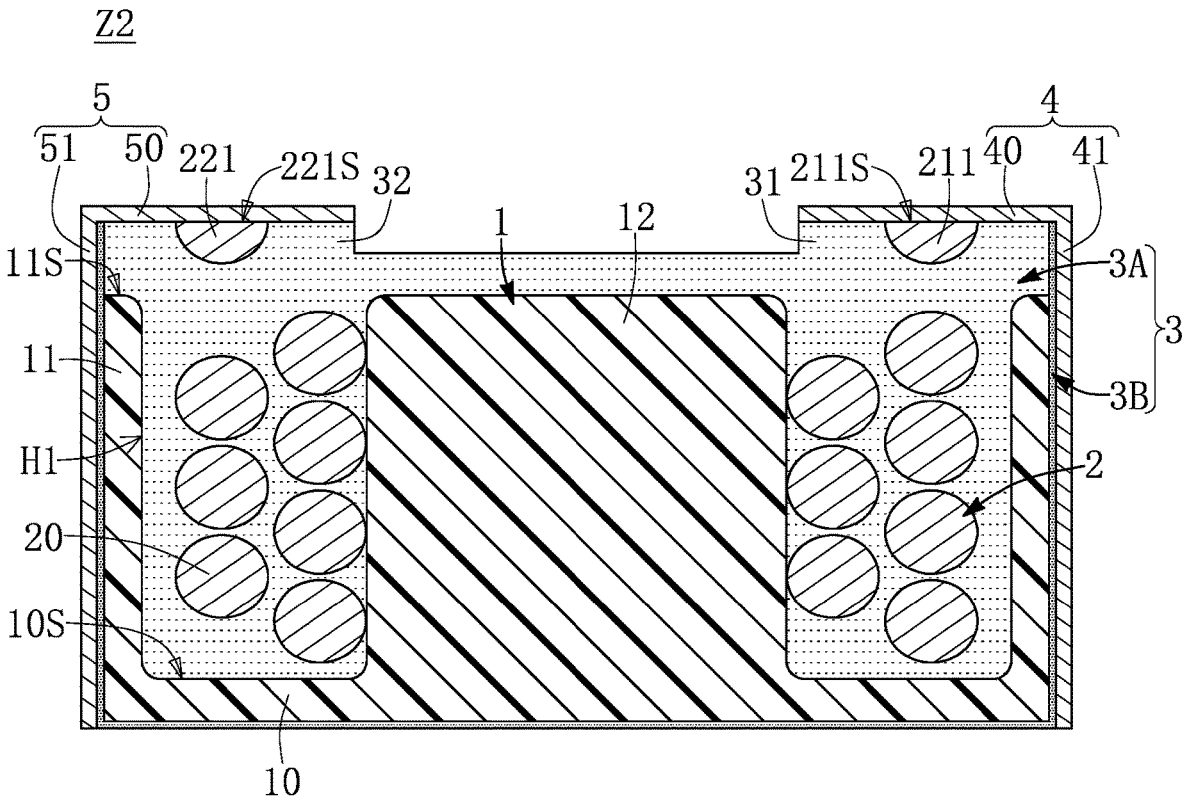
FIG. 11 is a schematic perspective view of an inductive device according to a second embodiment of the present disclosure.

However, the present disclosure is not limited to the structure of the electrode provided in the abovementioned embodiment. Reference is made to FIG. 11, which is a schematic perspective view of an inductive device according to a second embodiment of the present disclosure. The elements of the inductive device Z2 in the instant embodiment which are similar to or the same as those of the inductive device Z1 in the first embodiment are denoted by similar or the same reference numerals, and will not be reiterated herein.

As shown in FIG. 11, when the inductive device Z2 is disposed on another circuit board, and an interval of any two adjacent ones of the components on the circuit board are allowed to be larger, each of the first electrode 4 and the second electrode 5 can be an L-shaped electrode. That is to say, the first electrode 4 includes a first bottom portion 40 and a first lateral portion 41 that extends from the first bottom portion 40 to the side surface of the inductive device Z2. The first bottom portion 40 is located on the first protruding portion 31 and electrically connected to the first terminal portion 211. Furthermore, the second electrode 5 includes a second bottom portion 50 and a second lateral portion 51 that extends from the second bottom portion 50 to the side surface of the inductive device Z2. The second bottom portion 50 is located on the second protruding portion 32 and electrically connected to the second terminal portion 221.

When the inductive device Z2 is disposed on another circuit board, the first and second bottom portions 40, 50 face toward the circuit board. Furthermore, the arrangements of the first and second lateral portions 41, 42 allow a solder (such as a solder paste) to be easily wicked up to a greater extent, so that the bonding strength between the inductive device Z2 and the circuit board can be increased.

[Beneficial Effects of the Embodiments]

In conclusion, one of the advantages of inductive device and the method of manufacturing the same provided by the present disclosure is that by virtue of "the magnetic base 1 including a core column 12, and defining a positioning trench H1 therein that surrounds the core column 12," "the coil structure 2 being arranged in the positioning trench H1 and including a coil body 20, a first extending section 21 including a first bent portion 210 and a first terminal portion 211 connected thereto, and a second extending section 22 including a second bent portion 220 and a second terminal portion 221 connected thereto," "the first and second bent portions 210, 220 being bent from the coil body 20 toward the same direction, and respectively having a first connecting point 210*a* and a second connecting point 220*a*, in which a first imaginary connection line A is defined between the first and second connecting points 210*a*, 220*a*, and a shortest distance d1 between the first imaginary connection line A and a central axis Y of the core column 12 is less than a minimum outer radius Ra of the coil body 20" and "the first and second terminal portions 211, 221 respectively extending from the first and second connecting points 210*a*, 210*b* and protruding from a side surface of the coil body 20," the reliability of the inductive device can be maintained at a required level, and the inductive device Z1, Z2 can exhibit a better electrical performance.

Specifically, the coil structure 2 is arranged in the positioning trench H1 of the preformed magnetic base 1 before the molding process, the coil structure 2 can be prevented from being displaced or deformed due to being squeezed during the manufacturing method of the inductive device, which negatively impacts on the electrical properties and yield of the inductive device Z1, Z2. Moreover, compared to the magnetic body that is fabricated by molding magnetic powder, the preformed magnetic base 1 has a higher density. Accordingly, in the inductive device Z1, Z2 provided in the embodiments, the magnetic substance filling within the through hole 20H of the coil body 20 is denser, such that the inductive device Z1, Z2 has a higher inductance.

Since the shortest distance dl between the central axis Y of the core column 12 and the first imaginary connection line A defined between the first and second connecting points 210*a*, 220*a* is less than the minimum outer radius Ra of the coil body 20, and the first and second terminal portions 211, 221 respectively extend from the first and second connecting points 210*a*, 220*a*, a contact area (i.e., the area of first conductive part 211S) between the first terminal portion 211 and the first electrode 4 can be increased. As such, the bonding strength between the first terminal portion 211 and the first electrode 4 can be increased, thereby improving the reliability of the inductive device Z1, Z2. Similarly, a contact area (i.e., the area of the second conductive part 221S) between the second terminal portion 221 and the second electrode 5 can also be increased, thereby increasing the bonding strength and reducing the resistance between the second terminal portion 221 and the second electrode 5. As such, the inductive device Z1, Z2 can have better electrical properties.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An inductive device, comprising:

a magnetic base including a bottom plate, a lateral wall, and a core column, wherein the lateral wall and the core column both protrude from a surface of the bottom plate, and the bottom plate, the lateral wall and the core column jointly define a positioning trench;

a coil structure including:

a coil body disposed in the positioning trench and surrounding the core column;

a first extending section including a first bent portion and a first terminal portion connected thereto, wherein the first bent portion is bent from the coil body in a direction away from the bottom plate and has a first connecting point, and the first terminal portion extends from the first connecting point to a position above the lateral wall;

a second extending section including a second bent portion and a second terminal portion connected thereto, wherein the second bent portion is bent from the coil body in a direction away from the bottom plate and has a second connecting point, and the second terminal portion extends from the second connecting point to a position above the lateral wall; and a package structure covering the magnetic base and the coil structure, wherein a first conductive part of the first terminal portion and a second conductive part of the second terminal portion are both exposed outside of the package structure;

wherein a first imaginary connection line is defined between the first connecting point and the second connecting point, and a shortest distance between the first imaginary connection line and an axis of the core column is less than a minimum outer radius of the coil body, wherein the first imaginary connection line defined between the first connecting point and the second connecting point passes across the coil body and located above the coil body, wherein the first connecting point and the second connecting point are both located above a top surface of the lateral wall, the first imaginary connection line defined between the first connecting point and the second connecting point is disposed over the core column, and the first extending section and the second extending section are each bent from a first side of the coil body toward a top side of the coil body, and then bent again from the top side toward the first side of the coil body; and wherein the first bent portion has a first bent starting point, the second bent portion has a second bent starting point, a second imaginary connection line defined between the first and second bent starting points is contained in a longitudinal reference plane that contains the axis of the core column, the lateral wall is an enclosed wall, and an entire top surface of the lateral wall is a flat surface.

2. The inductive device according to claim 1, wherein the first terminal portion and the second terminal portion do not extend beyond an outer edge of the lateral wall.

3. The inductive device according to claim 1, wherein the shortest distance between the first imaginary connection line and the axis of the core column is equal to or less than two-third of a maximum outer radius of the coil body.

4. The inductive device according to claim 1, wherein the first bent portion and the first terminal portion form an S shape starting from the first bent starting point, and the second bent portion and the second terminal portion form another S shape starting from the second bent starting point.

5. The inductive device according to claim 1, wherein a height of the core column relative to the bottom plate is equal to or less than a height of the lateral wall relative to the bottom plate.

6. The inductive device according to claim 1, wherein a top end of the coil body is located at a height position lower than a height position of a top surface of the lateral wall and lower than a height position of a top surface of the core column.

7. The inductive device according to claim 1, further comprising: a first electrode and a second electrode, wherein the first electrode covers and is electrically connected to the first conductive part of the first terminal portion, and the second electrode covers and is electrically connected to the second conductive part of the second terminal portion.

8. The inductive device according to claim 1, wherein the package structure includes a first protruding portion and a second protruding portion that respectively correspond in position to the first terminal portion and the second terminal portion and spaced apart from each other, wherein the first conductive part and the second conductive part are exposed at surfaces of the first protruding portion and the second protruding portion, respectively.

9. The inductive device according to claim 8, wherein the first protruding portion and the first terminal portion extend in substantially a same direction, and the second protruding portion and the second terminal portion extend in substantially a same direction.

10. The inductive device according to claim 8, further comprising: a first electrode and a second electrode, wherein the first electrode is located at the first protruding portion and is in contact with the first conductive part so as to be electrically connected to the first terminal portion, and the second electrode is located at the second protruding portion and is in contact with the second conductive part so as to be electrically connected to the second terminal portion.

* * * * *